US010914076B1

(12) United States Patent
Santini

(10) Patent No.: US 10,914,076 B1
(45) Date of Patent: Feb. 9, 2021

(54) PIPE EXTRUSION

(71) Applicant: Patrick J. Santini, West Bend, WI (US)

(72) Inventor: Patrick J. Santini, West Bend, WI (US)

( * ) Notice: Subject to any disclaimer, the term of this patent is extended or adjusted under 35 U.S.C. 154(b) by 98 days.

(21) Appl. No.: 16/387,661

(22) Filed: Apr. 18, 2019

(51) Int. Cl.
*E04F 11/18* (2006.01)
*B21C 23/08* (2006.01)

(52) U.S. Cl.
CPC ..... *E04F 11/18* (2013.01); *B21C 23/085* (2013.01); *E04F 2011/1889* (2013.01)

(58) Field of Classification Search
CPC .. E04F 11/18; E04F 11/181; E04F 2011/1889
USPC ..... 138/DIG. 11, 177, 178, 111; D25/119, D25/124, 125, 38.1; 256/65.11, 22, 59
See application file for complete search history.

(56) References Cited

U.S. PATENT DOCUMENTS 4,102,529 A * 7/1978 Neblung ..... E04F 11/181 256/70
D275,324 S 8/1984 Wahlin
4,586,697 A * 5/1986 Tornya ..... E04F 11/181 256/22
D306,491 S * 3/1990 Hallengren ..... D25/124
5,022,702 A * 6/1991 Straub ..... B60J 5/065 160/84.01
8,615,964 B1 * 12/2013 Poma ..... E04F 11/1812 52/741.15
D806,267 S 12/2017 Madden
D833,648 S 11/2018 Shearer et al.
2006/0087152 A1 * 4/2006 Kuriakose ..... B62D 25/2054 296/184.1

* cited by examiner

*Primary Examiner* — Patrick F Brinson
(74) *Attorney, Agent, or Firm* — Donald J. Ersler

(57) ABSTRACT

A pipe extrusion includes a cross-section with a substantially round outer perimeter. A round portion of the substantially round outer perimeter preferably has an included angle of less than 300 degrees. A pair of inward facing flanges terminate the round portion. A cross member is formed across an inner area of the round portion. The cross member is parallel with the pair of inward facing flanges. A position of the cross member relative to a centerline of the round portion is between 0-20 degrees from the center line of the round portion. The pipe extrusion is preferably fabricated from any suitable aluminum alloy, such as T-6 aluminum.

12 Claims, 3 Drawing Sheets

PIPE EXTRUSION

BACKGROUND OF THE INVENTION

1. Field of the Invention

The present invention relates generally to pipes and more specifically to a pipe extrusion, which may be used as a handrail or a structural member in temporary structures.

2. Discussion of the Prior Art

Patent no. D275324 to Wahlin discloses a coupling for decorating purposes. Patent no. D806267 to Madden discloses a splice connector for handrails. Patent no. D833648 to Shearer et al. discloses a tubing with channel.

Accordingly, there is a clearly felt need in the art for a pipe extrusion, which may be used as a handrail or a structural member in temporary structures; used for suspending lights; and useable with slip-on couplings and fittings for round tubes.

SUMMARY OF THE INVENTION

The present invention provides a pipe extrusion, which is useable with slip-on couplings and fittings. The pipe extrusion includes a cross-section with a substantially round outer perimeter. A round portion of the substantially round outer perimeter preferably has an included angle of less than 300 degrees. A pair of inward facing flanges terminate the round portion. A cross member is formed across an inner area of the round portion. The cross member is preferably parallel with the pair of inward facing flanges. A position of the cross member relative to a centerline of the round portion is below a centerline of the round portion, while the pair of inward facing flanges are above the centerline. The pipe extrusion is fabricated from any suitable aluminum alloy, such as T-6 aluminum.

Accordingly, it is an object of the present invention to provide a pipe extrusion, which may be used as a handrail or a structural member in temporary structures.

It is a further object of the present invention to provide a pipe extrusion, which may be used for suspending lights.

Finally, it is another object of the present invention to provide a pipe extrusion, which may be useable with slip-on couplings and fittings for round tubes.

These and additional objects, advantages, features and benefits of the present invention will become apparent from the following specification.

DETAILED DESCRIPTION OF THE PREFERRED EMBODIMENTS

Figure 1:
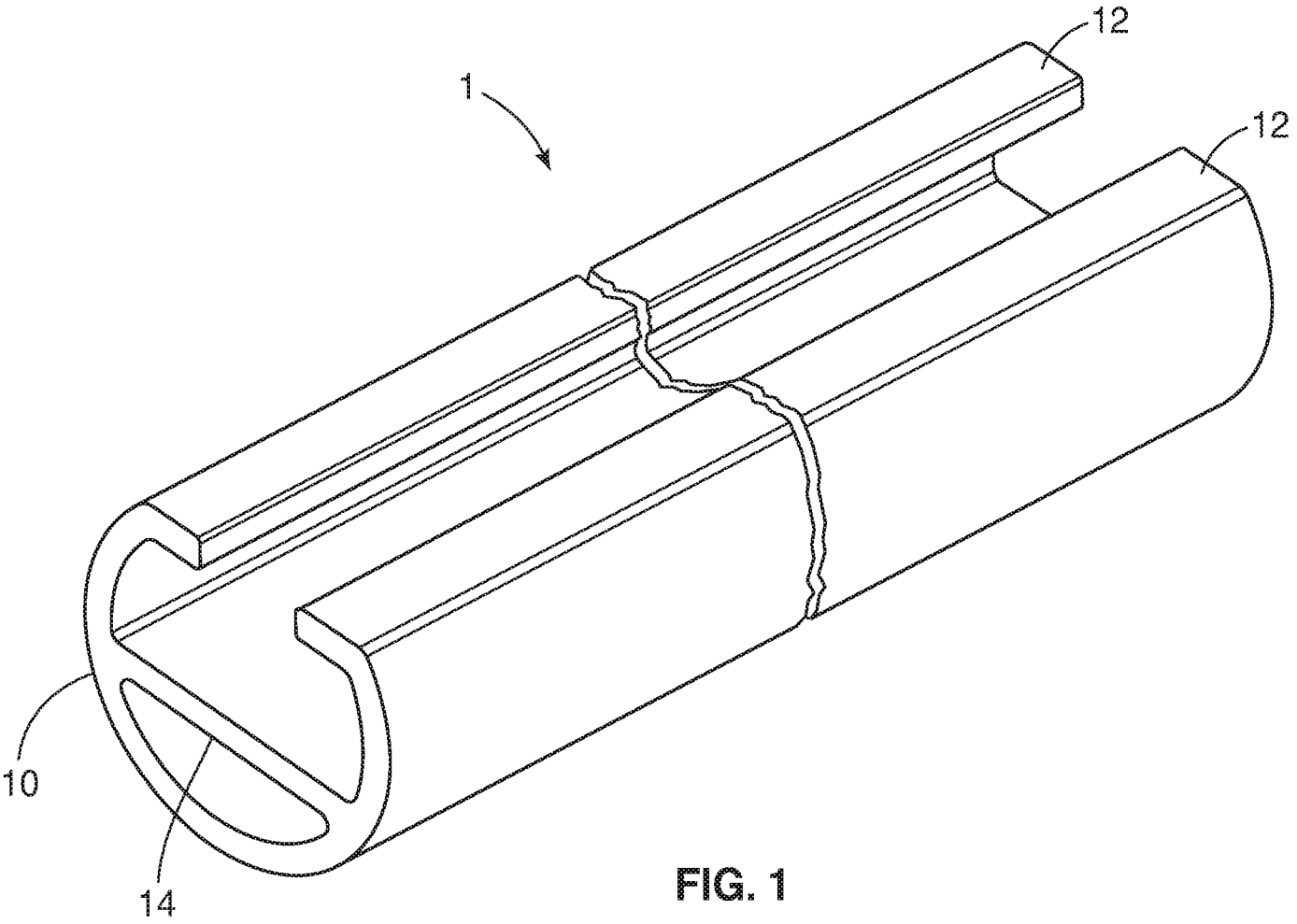
FIG. 1 is a perspective view of a pipe extrusion in accordance with the present invention.
Figure 2:
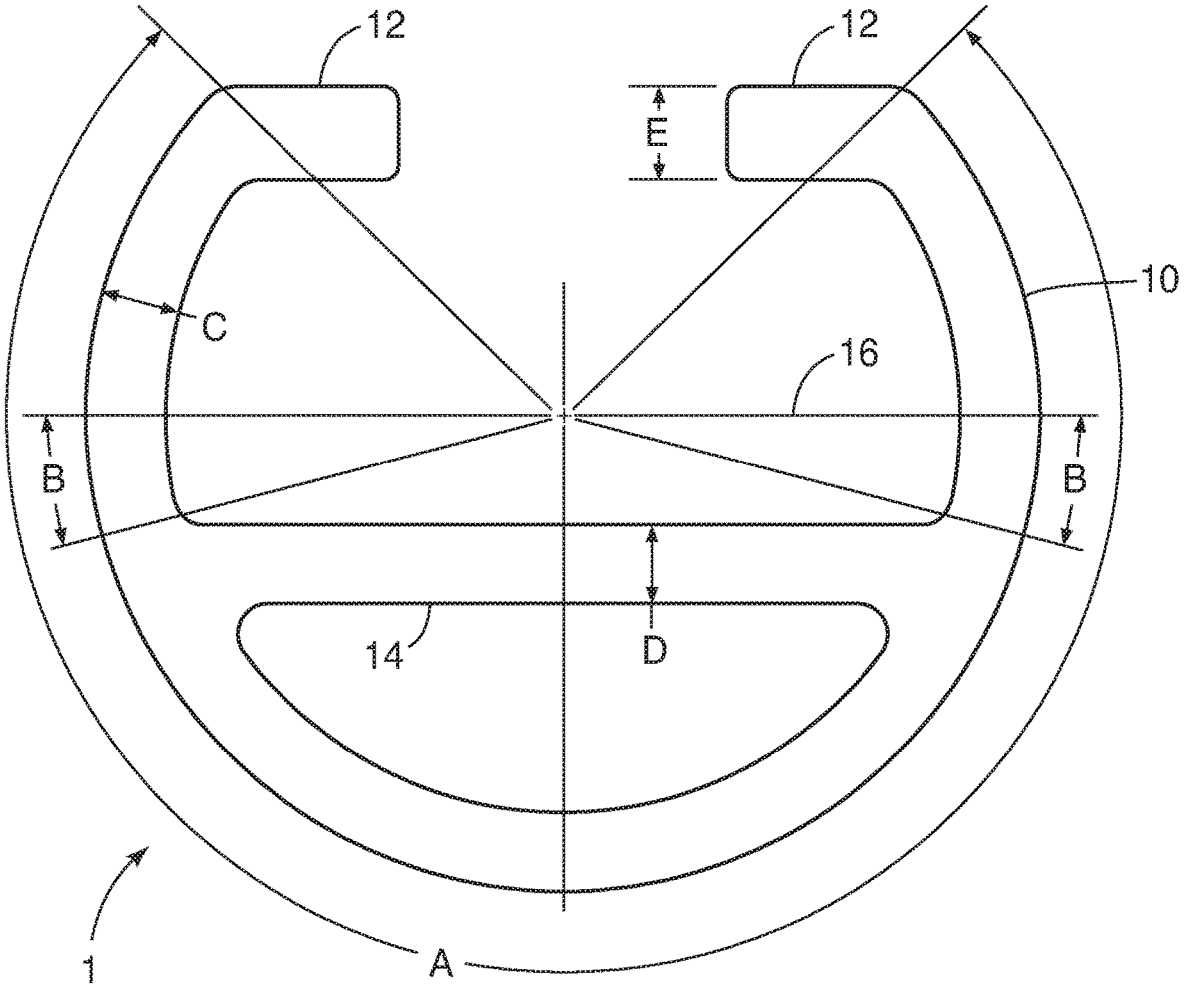
FIG. 2 is an end view of a pipe extrusion in accordance with the present invention.

With reference now to the drawings, and particularly to FIG. 1, there is shown a perspective view of a pipe extrusion 1. With reference to FIG. 2, the pipe extrusion 1 includes a cross-section with a substantially round outer perimeter. A round portion 10 of the substantially round outer perimeter preferably has an included angle "A" of less than 270 degrees. However, the angle "A" could be less than 280 degrees, 290 degrees or 300 degrees. A pair of inward facing flanges 12 terminate the round portion 10. A cross member 14 is formed across an inner area of the round portion 10. The cross member 14 is preferably parallel with the pair of inward facing flanges 12. A position of the cross member 14 relative to a centerline 16 of the round portion 10 preferably has an included angle "B" of between 15-20 degrees, which is below the centerline 16, while the pair of inward facing flanges 12 are located above the centerline 16. However, the angle "B" could be 10-15 degrees, 5-10 degrees, 5-0 degrees, or the centerline 16 may pass through the cross member 14. A wall of thickness C of the round portion 10 is preferably equal to a wall thickness D of the cross member 14.

Figure 3:
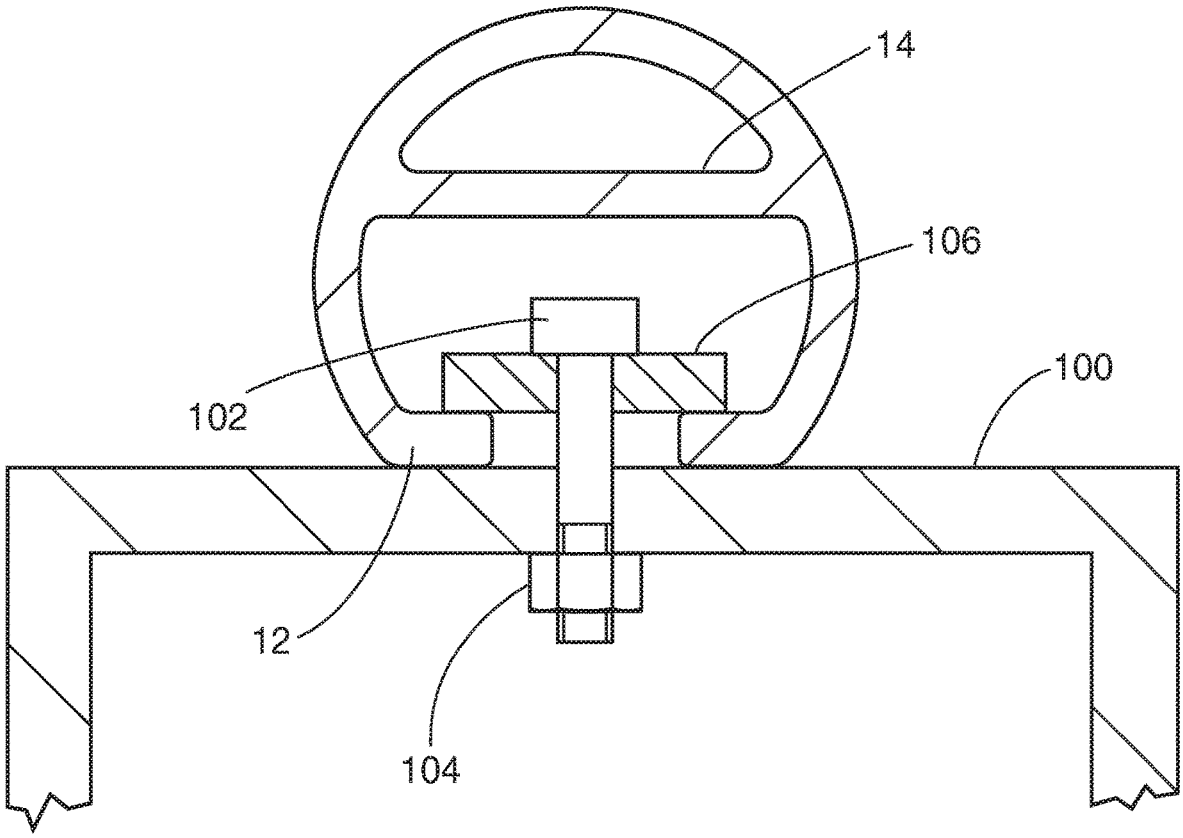
FIG. 3 is a cross-sectional view of a pipe extrusion secured to a modular beam in accordance with the present invention.

With reference to FIG. 3, a wall thickness E of the pair of inward facing flanges 12 is preferably greater than a thickness C or D. It is preferable to have thicker inward facing flanges 12 to withstand tear-away forces experienced by the pipe extrusion 1 relative to a mounting surface, such as a modular beam 100. The pipe extrusion 1 is attached to the modular beam 100 with a plurality of fasteners 102, 104 and at least one attachment plate 106. The pipe extrusion 1 is preferably fabricated from any suitable aluminum alloy, such as T-6 aluminum. However, any suitable material may also be used.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A pipe extrusion comprising:

a cross section having a substantially round outer perimeter, said substantially round outer perimeter includes a round portion, said round portion has an included angle of less than 300 degrees, a pair of inward facing flanges terminate said round portion, said pair of inward facing flanges each include a horizontal bottom surface and a horizontal top surface; and a cross member is formed across an inner area of said round portion.

2. The pipe extrusion of claim 1 wherein:

said pipe extrusion is fabricated from a T-6 aluminum.

3. The pipe extrusion of claim 1 wherein:

a wall thickness of said round portion is substantially the same as a thickness of said cross member.

4. The pipe extrusion of claim 1 wherein:

a thickness of said pair of inward facing flanges is greater than a thickness of said round portion or said cross member.

5. A pipe extrusion comprising:

a cross section having a substantially round outer perimeter and a centerline, said substantially round outer perimeter includes a round portion, said round portion has an included angle of less than 300 degrees, a pair of inward facing flanges terminate said round portion, said pair of inward facing flanges each include a horizontal bottom surface and a horizontal top surface; and a cross member is formed across an inner area of said round portion, said cross member is located below said centerline, said pair of inward facing flanges are located above said centerline.

6. The pipe extrusion of claim 5 wherein:

said pipe extrusion is fabricated from a T-6 aluminum.

7. The pipe extrusion of claim 5 wherein:

a wall thickness of said round portion is substantially the same as a thickness of said cross member.

8. The pipe extrusion of claim 5 wherein:

a thickness of said pair of inward facing flanges is greater than a thickness of said round portion or said cross member.

9. A pipe extrusion comprising:

a cross section having a substantially round outer perimeter and a centerline, said substantially round outer perimeter includes a round portion, said round portion has an included angle of less than 300 degrees, a pair of inward facing flanges terminate and flow from said round portion, said pair of inward facing flanges each include a horizontal bottom surface and a horizontal top surface; and a cross member is formed across an inner area of said round portion, said cross member is located below said centerline, said pair of inward facing flanges are located above said centerline, wherein said pair of inward facing flanges are capable of being secured to a support surface with fasteners.

10. The pipe extrusion of claim 9 wherein:

said pipe extrusion is fabricated from a T-6 aluminum.

11. The pipe extrusion of claim 9 wherein:

a wall thickness of said round portion is substantially the same as a thickness of said cross member.

12. The pipe extrusion of claim 9 wherein:

a thickness of said pair of inward facing flanges is greater than a thickness of said round portion or said cross member.

* * * * *